US010081888B2

(12) United States Patent
Ueda

(10) Patent No.: US 10,081,888 B2
(45) Date of Patent: Sep. 25, 2018

(54) INDUSTRIAL TWO-LAYER FABRIC

(71) Applicant: NIPPON FILCON CO., LTD., Inagi-shi, Tokyo (JP)

(72) Inventor: Ikuo Ueda, Fuji (JP)

(73) Assignee: NIPPON FILCON CO., LTD., Ingai-shi, Tokyo (JP)

( * ) Notice: Subject to any disclaimer, the term of this patent is extended or adjusted under 35 U.S.C. 154(b) by 0 days.

(21) Appl. No.: 15/306,210

(22) PCT Filed: Mar. 24, 2016

(86) PCT No.: PCT/JP2016/059307
§ 371 (c)(1),
(2) Date: Oct. 24, 2016

(87) PCT Pub. No.: WO2016/158640
PCT Pub. Date: Oct. 6, 2016

(65) Prior Publication Data

US 2018/0142385 A1 May 24, 2018

(30) Foreign Application Priority Data

Mar. 30, 2015 (JP) ..... 2015-067897

(51) Int. Cl.
*D03D 11/00* (2006.01)
*D21F 7/08* (2006.01)
(Continued)

(52) U.S. Cl.
CPC ..... *D03D 11/00* (2013.01); *D03D 1/00* (2013.01); *D21F 1/0045* (2013.01); *D10B 2505/00* (2013.01)

(58) Field of Classification Search
CPC ..... D21F 1/0036; D21F 1/0045; D21F 7/083; D03D 11/00
See application file for complete search history.

(56) References Cited

U.S. PATENT DOCUMENTS 6,896,009 B2 5/2005 Ward
6,959,737 B2 11/2005 Ward
(Continued)

FOREIGN PATENT DOCUMENTS

JP 49-075806 A 7/1974
JP 2004-36052 A 2/2004
(Continued)

OTHER PUBLICATIONS

International Search Report issued in Application No. PCT/JP2016/059307 with English translation dated Jun. 21, 2016 (3 pages).
(Continued)

*Primary Examiner* — Bobby Muromoto, Jr.
(74) *Attorney, Agent, or Firm* — Michael Best & Friedrich LLP

(57) ABSTRACT

An industrial two-layer fabric includes an upper layer fabric including upper side warps and upper side wefts and a lower layer fabric including lower side warps and lower side wefts, and the upper layer fabric and the lower layer fabric are bound by warps that function as binding yarns. The industrial two-layer fabric, warp knuckles are formed on a surface side, and each warp knuckle is formed by allowing a warp to pass over a single upper side weft; in a shaft adjacent to the warp knuckle, at least two other warp knuckles are arranged in a diagonal direction in a planar view; and the warp knuckles are sequentially arranged in such a way as to form a herringbone pattern on a surface layer side of the fabric.

4 Claims, 6 Drawing Sheets

(51) Int. Cl.

| | |
|---|---|
| ***D03D 1/00*** | (2006.01) |
| ***D21F 1/00*** | (2006.01) |
| *D03D 25/00* | (2006.01) |

(56) References Cited

U.S. PATENT DOCUMENTS

| | | | | |
|---|---|---|---|---|
| 7,270,151 | B2 * | 9/2007 | Nagura | D21F 1/0036 139/383 A |
| 7,306,014 | B2 * | 12/2007 | Nagura | D21F 1/0036 139/383 A |
| 7,343,938 | B2 * | 3/2008 | Takimoto | D21F 1/0036 139/383 A |
| 7,357,156 | B2 * | 4/2008 | Ueda | D21F 1/0036 139/383 A |
| 7,412,991 | B2 * | 8/2008 | Takimoto | D21F 1/0036 139/383 A |
| 7,441,566 | B2 | 10/2008 | Ward | |
| 7,464,731 | B2 * | 12/2008 | Fujisawa | D21F 1/0036 139/383 A |
| 7,484,537 | B2 * | 2/2009 | Ueda | D21F 1/0036 139/383 A |
| 8,809,211 | B2 * | 8/2014 | Ueda | D21F 1/0036 139/383 AA |
| 8,853,107 | B2 * | 10/2014 | Ueda | D21F 1/0036 139/383 AA |
| 2004/0182464 | A1 | 9/2004 | Ward | |
| 2004/0231745 | A1 * | 11/2004 | Quigley | D21F 1/0036 139/383 A |
| 2005/0067040 | A1 * | 3/2005 | Quigley | D21F 1/0045 139/383 A |
| 2005/0121097 | A1 | 6/2005 | Ward | |
| 2006/0040578 | A1 * | 2/2006 | Nagura | D21F 1/0036 442/239 |
| 2006/0112999 | A1 * | 6/2006 | Nagura | D21F 1/0036 139/383 A |
| 2006/0116042 | A1 * | 6/2006 | Nagura | D21F 1/0036 442/205 |
| 2006/0249220 | A1 * | 11/2006 | Barrett | D21F 1/0045 139/383 A |
| 2006/0260708 | A1 * | 11/2006 | Ueda | D21F 1/0036 139/383 A |
| 2007/0068590 | A1 * | 3/2007 | Quigley | D21F 1/0036 139/383 A |
| 2007/0095416 | A1 * | 5/2007 | Ueda | D21F 1/0036 139/383 A |
| 2007/0095417 | A1 * | 5/2007 | Fujisawa | D21F 1/0036 139/383 A |
| 2007/0101560 | A1 | 5/2007 | Luger | |
| 2007/0157987 | A1 | 7/2007 | Ward | |
| 2009/0050231 | A1 * | 2/2009 | Barrett | D21F 1/0036 139/383 A |
| 2011/0114278 | A1 * | 5/2011 | Stone | D21F 1/0045 162/289 |
| 2012/0135656 | A1 * | 5/2012 | Ueda | D21F 1/0036 442/203 |
| 2012/0135657 | A1 * | 5/2012 | Ueda | D21F 1/0036 442/203 |

FOREIGN PATENT DOCUMENTS

| | | | |
|---|---|---|---|
| JP | 2006-520862 | A | 9/2006 |
| JP | 2006-322109 | A | 11/2006 |

OTHER PUBLICATIONS

Written Opinion of International Searching Authority issued in Application No. PCT/JP2016/059307 dated Jun. 21, 2016 (5 pages).

* cited by examiner

INDUSTRIAL TWO-LAYER FABRIC

BACKGROUND OF THE INVENTION

Field of the Invention

The present invention relates to an industrial two-layer fabric having binding warps, and specifically relates to an industrial two-layer fabric that has no diagonal weave lines due to warp knuckles on the fabric surface, prevents transfer marks from forming by suppressing the separation or aggregation of adjacent wefts, and has excellent surface smoothness and running stability.

Background Art

Industrial fabrics woven with warps and wefts have been widely used, and are exemplified by papermaking fabrics, conveyor belts, and filter cloths. The respective fabrics are required to have fabric characteristics suited for the purposes and using environments. Of these fabrics, the papermaking fabrics used in a papermaking process of, for example, dehydrating raw materials through meshes of the fabric are required to have particularly strict characteristics. For example, there are demands for a fabric having such excellent surface smoothness as to be unlikely to transfer wire marks of the fabric to paper and for a fabric that has dehydration characteristics for sufficiently and evenly removing water excessively contained in raw materials, also has such rigidity and wear resistance as to be suitably used even in severe environments, and can further maintain conditions required for producing good paper for a long period of time. In addition, fiber supporting characteristics, an improvement of papermaking yield, dimensional stability, and running stability are also required, for example. In recent years, papermaking machines work at higher speeds, and accordingly the papermaking fabrics are required to have much higher characteristics.

A twill weave is known as a typical weave pattern for the industrial two-layer fabric (for example, see Patent Document 1). The industrial two-layer fabric having such a twill weave pattern has diagonal weave lines on the surface and thus has a problem of transferring such diagonal weave lines onto the surface of paper. The paper or the like having such transfer marks has a poor appearance and has an adverse effect on printing characteristics. For example, ink spreads on such paper in mark directions during printing. As the method for solving such problems, the technique of making the surface of a fabric have a satin weave, a satin weave, or a broken twill weave in place of the twill weave. For example, Patent Document 2 discloses a technique of improving the surface nature, the rigidity in diagonal directions, and the running stability by making the surface pattern of a fabric be a broken twill weave.

However, when a conventional technique such as a satin weave is applied to a fabric, the fabric has some areas where knuckles are not sequentially present, thus adjacent wefts aggregate, and such an uneven arrangement of the wefts causes transfer marks unfortunately.

When the industrial fabric having a broken twill weave on the surface and disclosed in Patent Document 2 is used, adjacent wefts are separated or aggregate with time due to the pattern structure, and the separation or aggregation is unfortunately transferred to paper or the like as new transfer marks. In other words, the paragraph [0007] in cited document 2 discloses that when these twill lines are connected to each other, deterioration in the rigidity of a wire in one direction and generation of diagonal marks, which will otherwise occur in the twill weave, can be prevented, but dog-leg twill lines stand out and their marks appear clearly. In this structure, an upper side warp adjacent to a peak passes over a knuckle adjacent to the peak, or over an upper side weft, next passes under an upper side weft, and then passes over an upper side weft, and thus the force pushing up an upper side weft is generated when the upper side warp passes under the upper side weft. Accordingly, twill lines are markedly observed as disclosed in cited document 2.

There is no pattern that is a broken twill weave pattern but suppresses the separation or aggregation of adjacent wefts, prevents transfer marks, and satisfies all the characteristics required for fabrics, such as surface smoothness and running stability.

CITATION LIST

Patent Documents

[Patent Document 1] Japanese Patent Laid-Open No. 2004-36052

[Patent Document 2] Japanese Patent Laid-Open No. 2006-322109

SUMMARY OF THE INVENTION

The present invention is directed to eliminate diagonal weave lines that appear on the surface of a fabric due to warp knuckles. The present invention is also directed to provide an industrial two-layer fabric that prevents transfer marks from forming by suppressing the separation or aggregation of adjacent wefts, which has occurred in conventional pattern structures, and has excellent surface smoothness and running stability.

The fabric pertaining to the present invention has been developed in order to eliminate diagonal weave lines and to suppress the separation or aggregation of wefts in the inside of the fabric. In other words, the present invention includes the following aspects in order to solve the problems in the related art.

(1) An industrial two-layer fabric includes an upper layer fabric including upper side warps and upper side wefts and a lower layer fabric including lower side warps and lower side wefts, and the upper layer fabric and the lower layer fabric are bound by warps that function as binding yarns. In the industrial two-layer fabric, warp knuckles are formed on a surface side, and each warp knuckle is formed by allowing a warp to pass over a single upper side weft; in a shaft adjacent to the warp knuckle, at least two other warp knuckles are arranged in a diagonal direction in a planar view; and the warp knuckles are sequentially arranged in such a way as to form a herringbone pattern on a surface layer side of the fabric.

In the present invention, the "warp knuckle" means the place where a binding warp passes over an upper side weft to form a knuckle on the surface of a fabric. The warps forming knuckles include upper side warps in addition to binding yarns.

In the present invention, "over a single upper side weft" means that a binding warp does not pass over two or more upper side wefts adjacent to each other but a binding warp passes over only a single upper side weft to form a single knuckle. Accordingly, the warp knuckle never forms a long crimp on the surface of a fabric.

In the present invention, the "herringbone pattern" is a pattern in which a predetermined number of warp knuckles are arranged to form parallel lines in a diagonal direction with respect to a running direction in a planar view, and then the same number of warp knuckles are arranged to form lines inverted in the normal direction, thereby forming a zigzag pattern by the warp knuckles on the upper layer surface of a fabric. In other words, at the peak of the inversion part in the zigzag pattern, a single warp knuckle is placed.

In the present invention, in one shaft adjacent to the warp knuckle placed at a peak, two other warp knuckles are arranged in upward and downward diagonal directions, and in each shaft adjacent to a warp knuckle arranged at the midpoint between a peak and a corresponding peak forming the zigzag pattern, another warp knuckle is arranged on a diagonal line (in a diagonal direction).

(2) In the industrial two-layer fabric according to the aspect (1), a minimum number of the warp knuckles sequentially arranged between peaks forming the herringbone pattern is 3, and a maximum number of the sequentially arranged warp knuckles is twice a number of the upper side warps in a complete design.

In the present invention, the minimum arrangement number of the warp knuckles in connection with each other is 3 in a diagonal direction in a planar view. In other words, when a single warp knuckle is arranged between peaks in a zigzag pattern, the minimum value is 3. By adopting twice the total number of the upper side warps in a complete design as the maximum number of the warp knuckles, one side of the zigzag pattern is formed.

(3) In the industrial two-layer fabric according to the aspect (1) or (2), the warp knuckle arranged at the peak of the herringbone pattern is the binding yarn.

(4) In the industrial two-layer fabric according to any one of the aspects (1) to (3), all knuckles formed by the upper side wefts appearing on the surface side of the fabric have an equal length.

The present invention advantageously provides an industrial two-layer fabric without diagonal weave lines by forming a herringbone pattern of warp knuckles on the surface of the fabric. In addition, the present invention advantageously provides an industrial two-layer fabric that prevents transfer marks from forming by suppressing the separation or aggregation of adjacent wefts, which has occurred in pattern structures of conventional fabrics, and has excellent surface smoothness and running stability.

DESCRIPTION OF THE PREFERRED EMBODIMENTS

Figure 1:
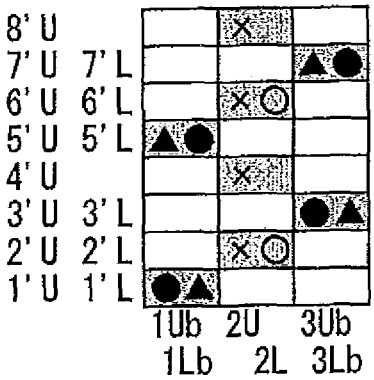
FIG. 1 is a design diagram illustrating a complete design of a first embodiment of an industrial two-layer fabric of the present invention.

An industrial two-layer fabric of the present invention will be described hereinafter in detail.

The industrial two-layer fabric of the present invention includes two layers, an upper layer fabric including upper side warps and upper side wefts and a lower layer fabric including lower side warps and lower side wefts. The upper layer fabric and the lower layer fabric are bound by warps that function as binding yarns.

The industrial two-layer fabric of the present invention is characterized in that warp knuckles are formed on the surface side, and each warp knuckle is formed by allowing a warp to pass over a single upper side weft. In shafts adjacent to the warp knuckle, at least two other warp knuckles are arranged in diagonal directions in a planar view, and the warp knuckles are sequentially arranged in such a way as to form a herringbone pattern on the surface layer side of the fabric.

In the present invention, a single binding yarn forms a knuckle on the upper layer fabric, and at places adjacent to the knuckle, two warp knuckles are formed in diagonal directions. Thus, an uneven shape generated around a warp knuckle formed by a single binding yarn can be cancelled by the stress relation with two adjacent warp knuckles. Accordingly, dehydration marks of the fabric are suppressed to be transferred to paper, and consequently, the fabric can prevent transfer marks from forming on a contact face of the paper with the fabric and have good surface smoothness.

The yarn used in the industrial two-layer fabric of the present invention can be selected depending on the purpose. The usable yarn is exemplified by monofilaments, multifilaments, spun yarns, finished yarns subjected to crimping or bulking, commonly called textured yarns, bulky yarns, and stretch yarns, and combination yarns prepared by intertwining them. As for the cross-section shape of the yarn, not only yarns having a circular shape but also yarns having a short shape such as a quadrangular shape and a star shape, yarns having an elliptical shape, and hollow yarns can be used. The raw material of the yarn can be freely selected, and usable examples include polyester, polyamide, polyphenylene sulfide, polyvinylidene fluoride, polypropylene, aramid, polyether ether ketone, polyethylene naphthalate, polytetrafluoroethylene, cotton, wool, and metals. Needless to say, yarns prepared from a copolymer and yarns prepared by blending or adding various substances to such a material can be used according to the purpose. For typical papermaking wires, polyester monofilaments having rigidity and excellent dimensional stability are preferably used as upper side warps, lower side warps, binding yarns, and upper side wefts. As lower side wefts required to have wear resistance, yarns are preferably interwoven to ensure the rigidity and to improve the wear resistance. For example, polyester monofilaments and polyamide monofilaments are alternately arranged.

Embodiments of the industrial two-layer fabric of the present invention will next be described. The embodiments described below are merely examples of the present invention and are not intended to limit the present invention.

Embodiments of the industrial two-layer fabric of the present invention will be described with reference to drawings. FIG. 1 to FIG. 7 are design diagrams illustrating first to fifth embodiments of the industrial two-layer fabric of the present invention. The complete designs shown below are the minimum repeating unit of a weave pattern, and the complete designs are connected vertically and horizontally to form the whole design of a fabric. In the design diagrams, warps are represented by Arabic numerals, for example, 1, 2, and 3. In the embodiments, the warps having a binding function are represented by b. Upper side warps are represented by U, and lower side warps are represented by L. Wefts are represented by Arabic numerals with a prime, for example, 1', 2', and 3'. Depending on an arrangement ratio, upper side wefts and lower side wefts are vertically arranged in some cases, and only upper side wefts are arranged in some cases. Upper side wefts are represented by U, and lower side wefts are represented by L.

The mark X indicates that an upper side warp is positioned over an upper side weft; the mark ● indicates that a binding yarn is positioned over an upper side weft; the mark ▲ indicates that a binding yarn is positioned under a lower side weft; and the mark ○ indicates that a lower side warp is positioned under a lower side weft.

Some upper side warps are vertically overlapped with some lower side warps, and some upper side wefts are vertically overlapped with some lower side weft. Depending on an arrangement ratio, no lower side weft is placed under some upper side wefts. In the design diagrams, yarns are exactly vertically overlapped, but this arrangement is for convenience of drawings. In an actual fabric, yarns may be displaced.

First Embodiment

FIG. 1 is a design diagram illustrating a complete design of a first embodiment of the industrial two-layer fabric of the present invention. The design diagram includes an upper side warp (2U), a lower side warp (2L), and two warp pairs including upper side binding warps (1Ub, 3Ub) and lower side binding warps (1Lb, 3Lb) having a binding function. A first warp pair is composed of 1Ub and 1Lb, and a second warp pair is composed of 3Ub and 3Lb. As shown in FIG. 1, a pair of the upper side warp (2U) and the lower side warp (2L) is arranged between the first warp pair and the second warp pair to form a six-shaft fabric. The arrangement ratio of upper side wefts and lower side wefts is 4:3.

Figure 2:
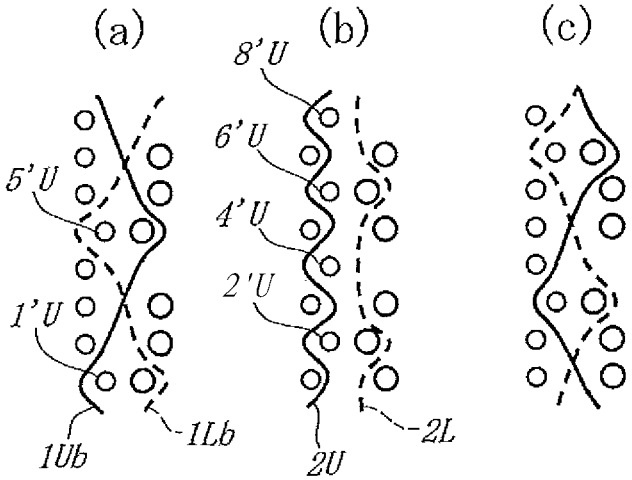
FIGS. 2 (*a*), (*b*) and (*c*) are schematic cross-sectional views of the first embodiment illustrated in FIG. 1 in the warp direction.

Each of the warp knuckles formed on the surface side is formed by allowing a warp to pass over a single upper side weft. For example, as shown in FIGS. 2 (*a*), (*b*) and (*c*), the upper side binding warp (1Ub) passes over the single upper side weft (1'U) and the single upper side weft (5'U) to form warp knuckles. The upper side warp (2U) also passes over each single weft of the upper side wefts (2'U, 4'U, 6'U, 8'U) to form warp knuckles. As shown in FIG. 1, in shafts adjacent to the warp knuckle (●/X), at least two other warp knuckles (●X) are arranged in diagonal directions in a planar view. For example, in diagonal directions in a planar view of the warp knuckle (●) formed by allowing the upper side binding warp (Mb) to pass over the upper side weft (3'U), the upper side warp (2U) passes over the upper side weft (2'U) to form another warp knuckle (X), and the upper side warp (20) passes over the upper side weft (4'U) to form another warp knuckle (X). In other words, two warp knuckles are arranged in the diagonal directions. In addition, in diagonal directions in a planar view of the warp knuckle (●) formed by allowing the upper side binding warp (1Ub) to pass over the upper side weft (1'U), the upper side warp (2U) passes over the upper side weft (2'U) to form another warp knuckle (X), and the upper side warp (2U) passes over the upper side weft (8'U) to form another warp knuckle (X). In other words, two warp knuckles are arranged in the diagonal directions.

By sequentially arranging warp knuckles as described above, a herringbone pattern can be formed on the surface layer side of a fabric. By forming the herringbone pattern as shown in FIG. 1, an industrial two-layer fabric without diagonal weave lines can be provided.

In the industrial fabric of the first embodiment, the number of warp knuckles sequentially arranged between peaks forming the herringbone pattern is 3.

A single binding yarn forms a knuckle on the upper layer fabric, and at places adjacent to the knuckle, two warp knuckles are formed in diagonal directions. Thus, an uneven shape generated around a warp knuckle formed by a single binding yarn can be cancelled by the stress relation with two adjacent warp knuckles. Hence, an industrial two-layer fabric that prevents transfer marks from forming on a contact face of paper with the fabric and has excellent surface smoothness and running stability can be provided.

Second Embodiment

Figure 3:
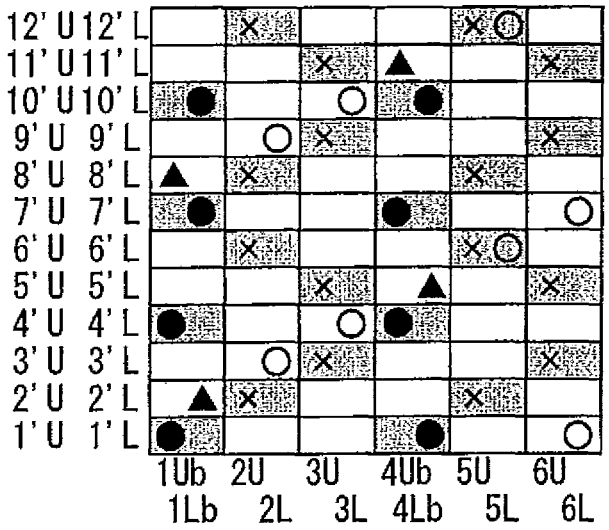
FIG. 3 is a design diagram illustrating a complete design of a second embodiment of the industrial two-layer fabric of the present invention.

FIG. 3 is a design diagram illustrating a complete design of a second embodiment of the industrial two-layer fabric of the present invention. The design diagram includes upper side warps (2U, 3U, 5U, 6U), lower side warps (2L, 3L, 5L, 6L), and two warp pairs including upper side binding warps (1Ub, 4Ub) and lower side binding warps (1Lb, 4Lb) having a binding function. A first warp pair is composed of 1Ub and 1Lb, and a second warp pair is composed of 4Ub and 4Lb. The industrial two-layer fabric of the second embodiment is a 12-shaft fabric. The arrangement ratio of upper side wefts and lower side wefts is 1:1.

Figure 4:
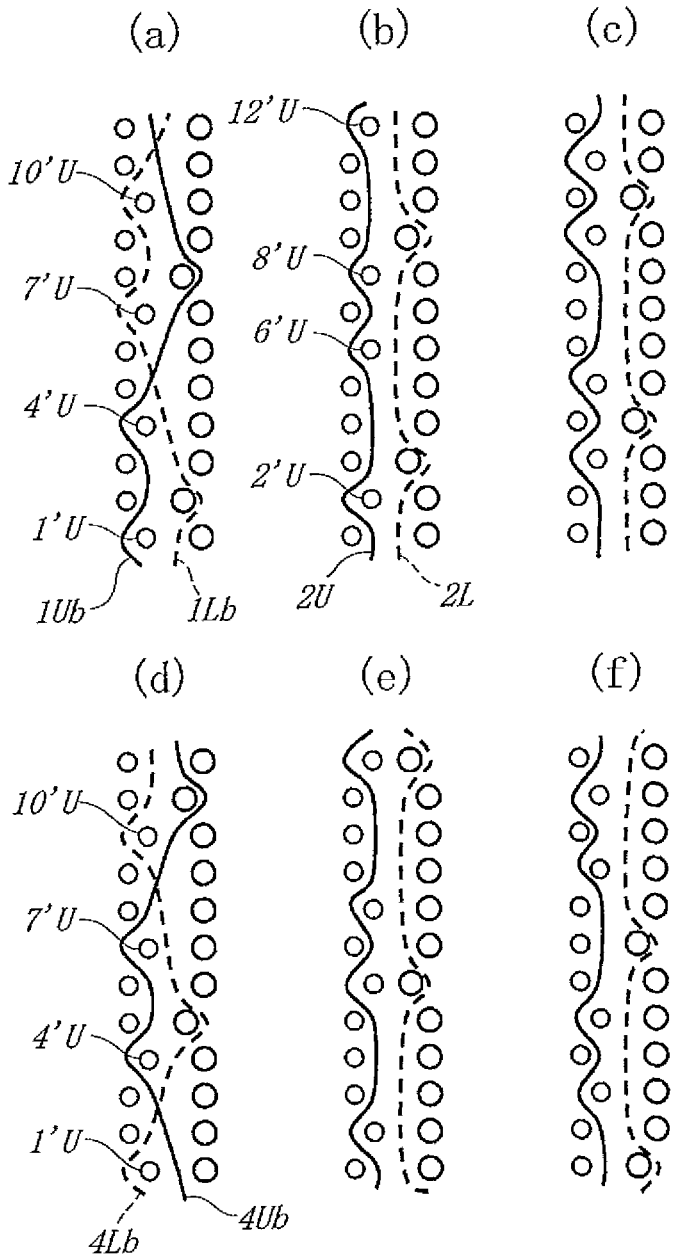
FIGS. 4 (*a*), (*b*), (*c*), (*d*), (*e*) and (*f*) are schematic cross-sectional views of the second embodiment illustrated in FIG. 3 in the warp direction.

Each of the warp knuckles formed on the surface side is formed by allowing a warp to pass over a single upper side weft. For example, as shown in FIGS. 4 (*a*), (*b*), (*c*), (*d*), (*e*) and (*f*), the upper side binding warp (1Ub) passes over the single upper side weft (1'U) and the single upper side weft (4'U) to form warp knuckles, and the lower side binding warp (1Lb) passes over the single upper side weft (7'U) and the single upper side weft (10'U) to form warp knuckles. The upper side warp (2U) also passes over each single weft of the upper side wefts (2'U, 6'U, 8'U, 12'U) to form warp knuckles.

As shown in FIG. 3, in shafts adjacent to the warp knuckle (●X), at least two other warp knuckles (●X) are arranged in diagonal directions in a planar view. For example, in diagonal directions in a planar view (on the left side in FIG. 3) of the warp knuckle (●) formed by allowing the upper side binding warp (4Ub) to pass over the upper side weft (4'U), the upper side warp (3U) passes over the upper side weft (3'U) to form another warp knuckle (X), and the upper side warp (3U) passes over the upper side weft (5'U) to form another warp knuckle (X). In other words, two warp knuckles are arranged in the diagonal directions. In addition, in diagonal directions in a planar view of the warp knuckle (●) formed by allowing the upper side binding warp (1Ub) to pass over the upper side weft (1'U), the upper side warp (2U) passes over the upper side weft (2'U) to form another warp knuckle (X), and the upper side warp (2U) passes over the upper side weft (12'U) to form another warp knuckle (X). In other words, two warp knuckles are arranged in the diagonal directions. In a diagonal direction in a planar view (on the left side in FIG. 3) of the warp knuckle (X) formed by allowing the upper side warp (2U) to pass over the upper side weft (2'U), the upper side binding warp (1Ub) passes over the upper side weft (1'U) to form another warp knuckle (●), and in a diagonal direction on the right side in FIG. 3, the upper side warp (3U) passes over the upper side weft (3'U) to form another warp knuckle (X). In other words, two warp knuckles are arranged in the diagonal directions.

By sequentially arranging warp knuckles as described above, a herringbone pattern can be formed on the surface layer side of a fabric. In the herringbone pattern of the second embodiment, the upper side binding warp 1Ub passes over the upper side wefts (1'U, 4'U,) to form two warp knuckles (●); the lower side binding warp 1Lb passes over the upper side wefts (7'U, 10'U) to form two warp knuckles (●); the upper side binding warp 4Ub passes over the upper side wefts (4'U, 7'U,) to form two warp knuckles (●); and the lower side binding warp 4Lb passes over the upper side wefts (1'U, 10'U) to form two warp knuckles (●). These eight warp knuckles correspond to peaks of the herringbone pattern. The industrial fabric of the second embodiment is characterized in that all the eight warp knuckles are formed by binding yarns.

In the industrial fabric of the second embodiment, the number of warp knuckles sequentially arranged between peaks forming the herringbone pattern is 4.

By forming the herringbone pattern as shown in FIG. 3, an industrial two-layer fabric without diagonal weave lines can be provided.

A single binding yarn forms a knuckle on the upper layer fabric, and at places adjacent to the knuckle, two warp knuckles are formed in diagonal directions. Thus, an uneven shape generated around a warp knuckle formed by a single binding yarn can be cancelled by the stress relation with two adjacent warp knuckles. Hence, an industrial two-layer fabric that prevents transfer marks from forming on a contact face of paper with the fabric and has excellent surface smoothness and running stability can be provided.

Third Embodiment

Figure 5:
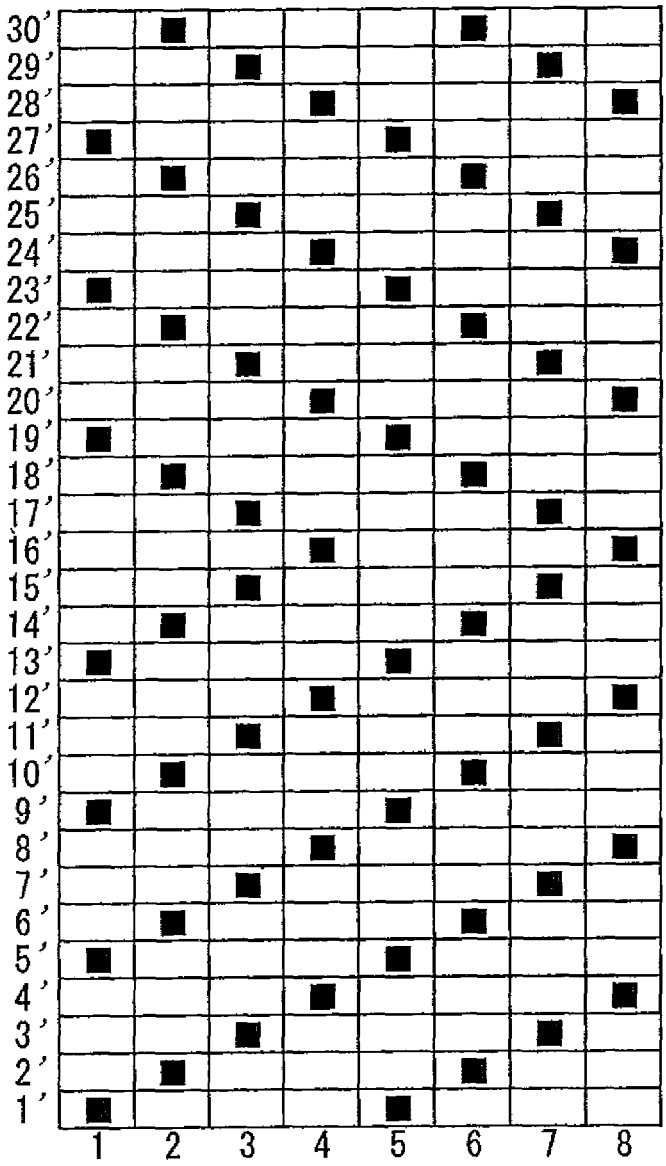
FIG. 5 is a design diagram partly illustrating a surface pattern of a third embodiment of the industrial two-layer fabric of the present invention.

FIG. 5 is a design diagram partly illustrating a surface pattern of a third embodiment of the industrial two-layer fabric of the present invention. In the drawing, the mark ■ indicates a warp knuckle formed by a binding yarn or an upper side warp. The same is applied to fourth and fifth embodiments.

As shown in FIG. 5, the surface pattern of the industrial two-layer fabric of the third embodiment includes eight upper side warps and binding warps.

In the industrial two-layer fabric of the third embodiment, the number of warp knuckles between peaks forming a herringbone pattern is 16, which is twice the number of upper side warps, 8. In other words, the number of warp knuckles sequentially arranged is 16 in total: from the warp knuckle as the peak at the intersection of warp 8 and weft 16, warp 7-weft 15, warp 6-weft 14, warp 5-weft 13, warp 4-weft 12, warp 3-weft 11, warp 2-weft 10, warp 1-weft 9, warp 8-weft 8, warp 7-weft 7, warp 6-weft 6, warp 5-weft 5, warp 4-weft 4, warp 3-weft 3, warp 2-weft 2, to warp 1-weft 1 as the other peak at which the line is inverted in the normal direction to form a zigzag pattern.

By sequentially arranging warp knuckles as described above, a herringbone pattern can be formed on the surface layer side of a fabric. Thus, an industrial two-layer fabric having no diagonal weave lines, giving no transfer marks, and having excellent surface smoothness and running stability can be provided.

Fourth Embodiment

Figure 6:
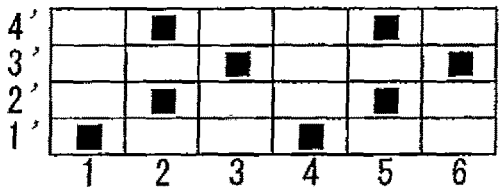
FIG. 6 is a design diagram partly illustrating a surface pattern of a fourth embodiment of the industrial two-layer fabric of the present invention.

FIG. 6 is a design diagram partly illustrating a surface pattern of a fourth embodiment of the industrial two-layer fabric of the present invention. As shown in FIG. 6, the surface pattern of the industrial two-layer fabric of the fourth embodiment includes six upper side warps and binding warps.

In the industrial two-layer fabric of the fourth embodiment, the number of warp knuckles between peaks forming a herringbone pattern is 3. The number of peaks of the herringbone pattern is four in total: warp 1-weft 1, warp 3-weft 3, warp 4-weft 1, and warp 6-weft 3. Such complete designs are connected vertically and horizontally to form a herringbone pattern in a running direction. Thus, an industrial two-layer fabric having no diagonal weave lines, giving no transfer marks, and having excellent surface smoothness and running stability can be provided.

Fifth Embodiment

Figure 7:
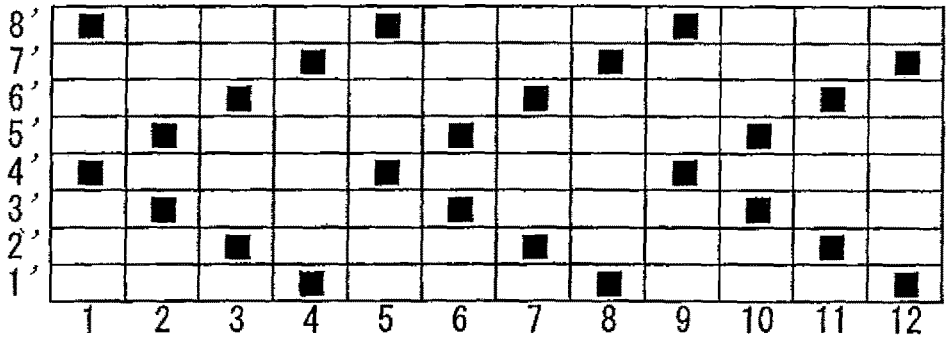
FIG. 7 is a design diagram partly illustrating a surface pattern of a fifth embodiment of the industrial two-layer fabric of the present invention.

FIG. 7 is a design diagram partly illustrating a surface pattern of a fifth embodiment of the industrial two-layer fabric of the present invention. As shown in FIG. 7, the surface pattern of the industrial two-layer fabric of the fifth embodiment includes 12 upper side warps and binding warps.

In the industrial two-layer fabric of the fifth embodiment, the number of warp knuckles between peaks forming a herringbone pattern is 5. The number of peaks of the herringbone pattern is 6 in total: warp 1-weft 4, warp 1-weft 8, warp 5-weft 4, warp 5-weft 8, warp 9-weft 4, and warp 9-weft 8. Such complete designs are connected vertically and horizontally to form a herringbone pattern in a running direction. Thus, an industrial two-layer fabric having no diagonal weave lines, giving no transfer marks, and having excellent surface smoothness and running stability can be provided.

Figure 8:
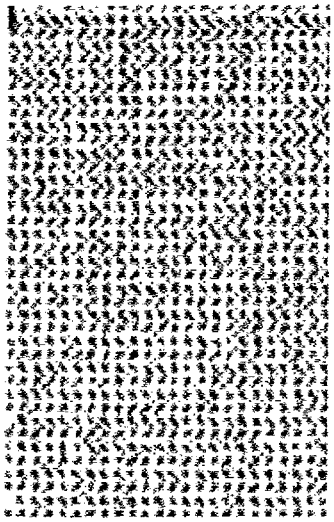
FIG. 8 is a photograph illustrating the result of a surface printing mark test on the industrial two-layer fabric of the present invention.
Figure 9:
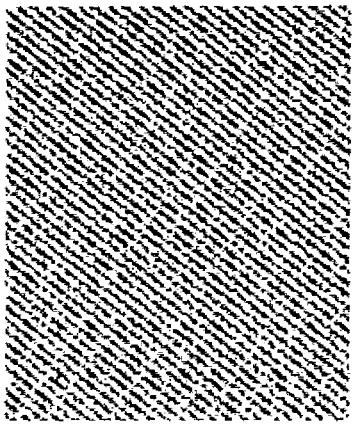
FIG. 9 is a photograph illustrating the result of a surface printing mark test on a conventional industrial two-layer fabric.

FIG. 8 is a photograph illustrating the result of a surface printing mark test on an industrial two-layer fabric that was produced in accordance with the second embodiment. FIG. 9 is a photograph illustrating the result of a surface printing mark test on a conventional fabric that was produced to have a twill weave pattern.

Black areas are projected areas on the fabric surface. FIG. 9 shows transfer marks that are sequentially arranged in diagonal directions on the industrial two-layer fabric. In contrast, FIG. 8 shows comparatively clear black dots that appear to form a herringbone pattern on the industrial two-layer fabric of the embodiment. On the industrial two-layer fabric of the present invention, no transfer marks are observed in diagonal directions. In other words, it has been revealed that the industrial two-layer fabric of the embodiment achieves such significant effects that dehydration marks are suppressed to be transferred to paper and the surface smoothness is improved without increases in mesh thickness as compared with conventional industrial two-layer fabrics.

DESCRIPTION OF REFERENCE SIGNS

1 to 12 warp
1' to 30' weft

U upper yarn
L lower yarn
b binding yarn

What is claimed is:

1. An industrial two-layer fabric comprising:

an upper layer fabric including upper side warps and upper side wefts; and a lower layer fabric including lower side warps and lower side wefts, the upper layer fabric and the lower layer fabric being bound by warps that function as binding yarns, warp knuckles being formed on a surface side, each warp knuckle being formed by allowing a warp to pass over a single upper side weft, in a shaft adjacent to the warp knuckle, at least two other warp knuckles being arranged in a diagonal direction in a planar view, the warp knuckles being sequentially arranged in such a way as to form a herringbone pattern on a surface layer side of the fabric.

2. The industrial two-layer fabric according to claim 1, wherein a minimum number of the warp knuckles sequentially arranged between peaks forming the herringbone pattern is 3, and a maximum number of the sequentially arranged warp knuckles is twice a number of the upper side warps in a complete design.

3. The industrial two-layer fabric according to claim 1, wherein the warp knuckle arranged at the peak of the herringbone pattern is the binding yarn.

4. The industrial two-layer fabric according to claim 1, wherein all knuckles formed by the upper side wefts appearing on the surface side of the fabric have an equal length.

* * * * *